US006280079B1

(12) United States Patent
Yang et al.

(10) Patent No.: US 6,280,079 B1
(45) Date of Patent: Aug. 28, 2001

(54) METHOD OF MIXING SLURRIES

(75) Inventors: Ming-Sheng Yang, Hsinchu; Peng-Yih Peng, Hsinchu-Hsien; Chia-Jui Chang, Chilung; Juan-Yuan Wu, Hsinchu, all of (TW)

(73) Assignee: United Microelectronics Corp., Hsinchu (TW)

( * ) Notice: Subject to any disclaimer, the term of this patent is extended or adjusted under 35 U.S.C. 154(b) by 0 days.

(21) Appl. No.: 09/220,535

(22) Filed: Dec. 24, 1998

(51) Int. Cl.[7] ..... B01F 5/00; B24B 1/00

(52) U.S. Cl. ..... 366/348; 366/263; 451/61

(58) Field of Search ..... 366/165.1, 165.3, 366/165.4, 165.5, 168.2, 280, 315, 317, 325.92, 325.93, 262, 263, 270, 274, 348, 159.1, 265, 343; 451/446, 60

(56) References Cited

U.S. PATENT DOCUMENTS 1,084,210 * 1/1914 Howard .
3,679,182 * 7/1972 Clocker .
4,105,798 * 8/1978 Moore et al. .
4,242,841 * 1/1981 Ushakov et al. ..... 366/159.1
4,453,829 * 6/1984 Althouse, III ..... 366/262
4,459,030 * 7/1984 Weetman ..... 366/262
4,616,073 * 10/1986 Antonucci .
4,802,825 * 2/1989 Hermans .
4,850,702 * 7/1989 Arribau et al. .
4,893,941 * 1/1990 Wayte .
4,915,505 * 4/1990 Arribau et al. .
4,983,046 * 1/1991 Murata et al. .
5,160,041 * 11/1992 Taniguchi et al. .
5,256,739 * 10/1993 Ono et al. .
5,318,360 * 6/1994 Langer et al. .
5,599,101 * 2/1997 Pardikes .
5,750,440 * 5/1998 Vanell et al. ..... 366/154.1
5,775,980 * 7/1998 Sasaki et al. ..... 451/7
6,021,806 * 2/2000 Lee ..... 137/393
6,106,714 * 8/2000 Chiu et al. ..... 366/274
6,109,778 * 8/2000 Wilmer ..... 366/165.5
6,123,602 * 9/2000 Rodriguez et al. ..... 451/5
6,124,207 * 9/2000 Robinson et al. ..... 438/692

* cited by examiner

*Primary Examiner*—Tony G. Soohoo
(74) *Attorney, Agent, or Firm*—Thomas, Kayden, Horstemeyer & Risley, LLP

(57) ABSTRACT

A slurry mixing apparatus has a mixing chamber, a rotatable bearing and several blades. The bearing is connected to one end of each of the blades and located in the center of the mixing chamber. Several kinds of the slurries can be mixed rapidly in the apparatus and flowed into the CMP polisher immediately to perform a CMP process. Being mixed by the mixing chamber, the slurry is supplied to the chemical mechanical polisher for polishing.

8 Claims, 5 Drawing Sheets

METHOD OF MIXING SLURRIES

BACKGROUND OF THE INVENTION

1. Field of the Invention

The invention relates to chemical mechanical polishing (CMP) polisher and more particularly to a slurry mixing apparatus for the CMP polisher.

2. Description of the Related Art

Planarization is an important technology in semiconductor process. The surface of the wafer has an even topography after planarization and it is able to prevent exposure light source from being scattered, so that the pattern transfer can be carried out precisely. Planarization technology mainly includes two methods, spin-on glass (SOG) and chemical mechanical polishing (CMP). SOG can not satisfy gradually the requirement of planarization as the semiconductor technique enters the field of sub-half-micron. CMP is the only process currently that can provide global planarization in very-large scale integration (VLSI) and ultra-large scale integration (ULSI).

CMP is a planarization process to planarize an uneven surface by applying mechanical polishing and adding suitable chemical reagent and slurry. When conditional parameters of process can be controlled appropriately, the planarization degree may reach 94% by CMP. Referring to FIG. 1 and FIG. 2, schematic top view and side view of a CMP polisher known in prior art are shown respectively. A holder 102 holds a backside 106 of a wafer 112, and a front side 120 of the wafer 112 is facing a polish pad 114 on a polish table 100. A slurry 110 from a slurry supplier 118 is pumped into a pipe 104 by a pump 116, and thus, the slurry 110 can be supplied to the polish pad 114 continually. The chemical reagent in the slurry 110 is reacted with the front side 120 of the wafer 112, and the polish table 100 and the holder 102 are rotated along directions 108*a*, 108*b* to polish the wafer 112 mechanically by particles in the slurry 110. Chemical reaction and mechanical polishing are repetitively applied on the wafer, and an even surface can be therefore obtained by the planarized process of CMP.

The quality of the slurry determines the stability of the process, so it is important in the planarized process of CMP. Chemical reaction and mechanical polishing are decided by chemical reagent and particles in the slurry respectively. The slurry needs to be diluted by solvent and then can be used, so that the slurry is varied from different materials and it is often necessary to use two kinds of slurry to planarized the wafer.

Since the slurry needs to be diluted to a suitable concentration, a premixer (not shown) is added in the slurry supplier 118 to mix slurry in advance. However, the property of the slurry is easily varied after being mixed. Thus, the slurry has to be consumed after being mixed and before reaching a Pot life. Due to the instability of the mixed slurry, another in-situ slurry mixing apparatus is developed due to the unstable property of the pre-mixed slurry.

Referring to FIG. 3, it shows a side view of an in-situ slurry mixing apparatus in prior art. The in-situ slurry mixing apparatus includes a pipe 202, a pipe 204 (in order to simplify the illustration, only pipes 202, 204 are shown in FIG. 3) and a slurry pipe 206. Different slurries are pumped into the slurry pipe 206 through the direction shown as arrow 202*a*, 204*a* from pipes 202, 204. The slurry in the slurry pipe 206 is directly provided onto the polished pad (such as 110 shown in FIG. 2) along the direction of the arrow 206*a*. However, the mixing time of the in-situ slurry mixing apparatus is too short to cause nonuniformity of the slurry, so that the quality of the slurry can not be easily controlled and result in worse performance of CMP.

SUMMARY OF THE INVENTION

It is therefore an object of the invention to provide a slurry mixing apparatus for the CMP polisher. The slurry mixing apparatus solves the problem of time-varying-property of the pre-mixing slurry.

It is another object of the invention to provide a slurry mixing apparatus for the CMP polisher. The slurry mixing apparatus solves the problem of nonuniform mixed slurry from the in-situ slurry mixing apparatus.

To achieve these objects and advantages, and in accordance with the purpose of the invention, as embodied and broadly described herein, the invention is directed towards a slurry mixing apparatus. The apparatus includes a mixing chamber, a rotatable bearing and several blades. The bearing is connected to the blades and installed in the mixing chamber. Several kinds of the slurries can be mixed rapidly in the apparatus and flowed into the CMP polisher immediately to perform a CMP process. The disadvantage of property of pre-mixing slurry being varied from time can be solved and the problem of nonuniform slurry due to in-situ slurry mixing can be overcome. The quality of the mixing slurry is thus improved.

It is to be understood that both the foregoing general description and the following detailed description are exemplary and explanatory only and are not restrictive of the invention as claimed.

DESCRIPTION OF THE PREFERRED EMBODIMENTS

Figure 4:
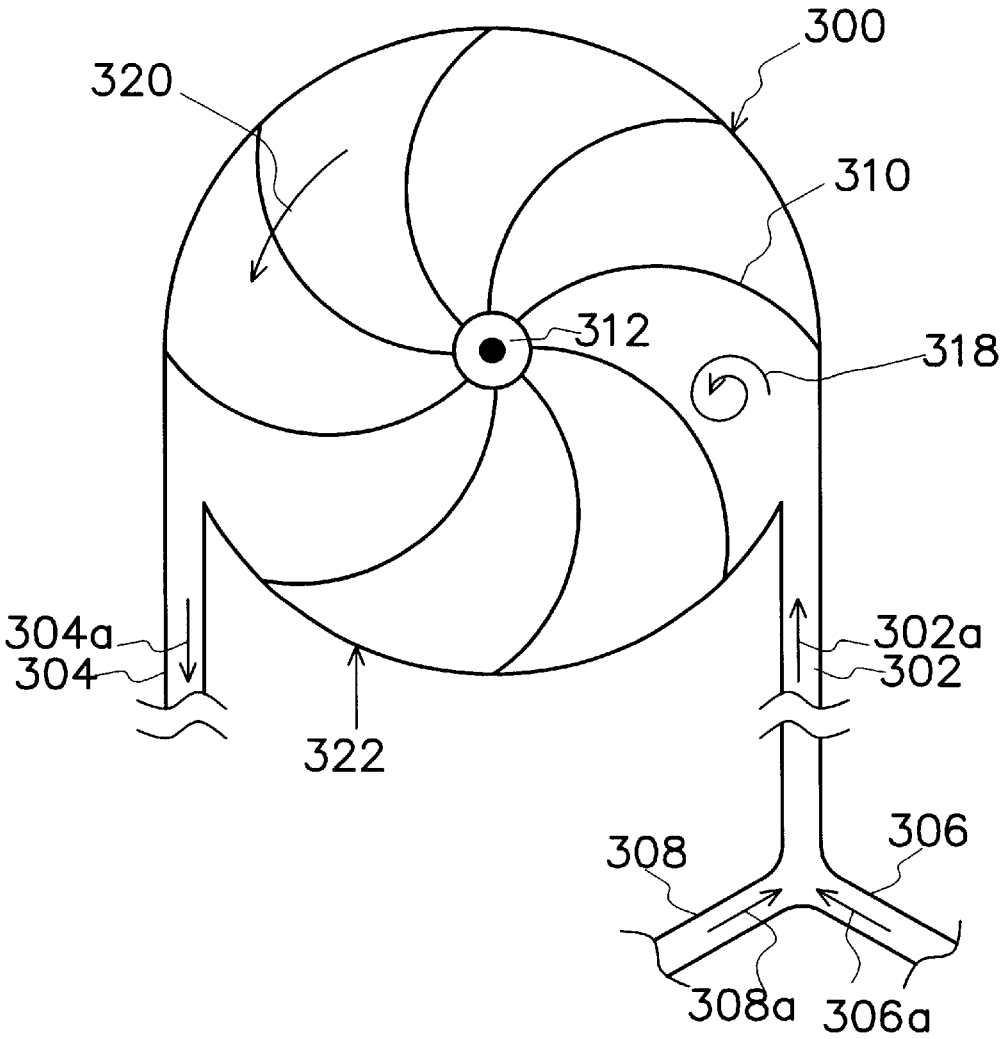
FIG. 4 shows schematic view of a slurry mixing apparatus according to the invention.
Figure 5:
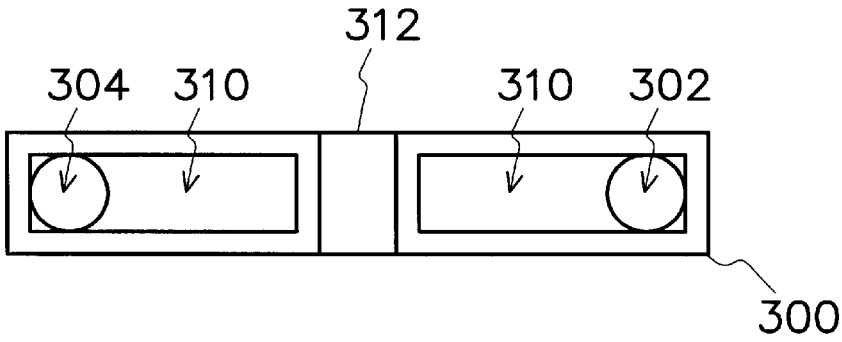
FIG. 5 shows schematic side view of a slurry mixing apparatus according to the invention.

FIG. 4 and FIG. 5 show respectively schematic top view and side view of a slurry mixing apparatus according to the invention. The apparatus includes a mixing chamber 300 having a surrounding wall 322, a rotatable bearing 312 located at a central point of the mixing chamber, and several stirring blades 310 each with one end connected to the rotatable bearing 312, the other end close to the surrounding wall 322. Both the rotatable bearing the stirring blades are enclosed by the surrounding wall 322. The stirring blades 310 may be shaped embowed, curved, or flat. The mixing chamber 300 also includes a slurry input pipe 302 and a slurry output pipe 304 to transport a slurry in and out of the mixing chamber 300.

Figure 1:
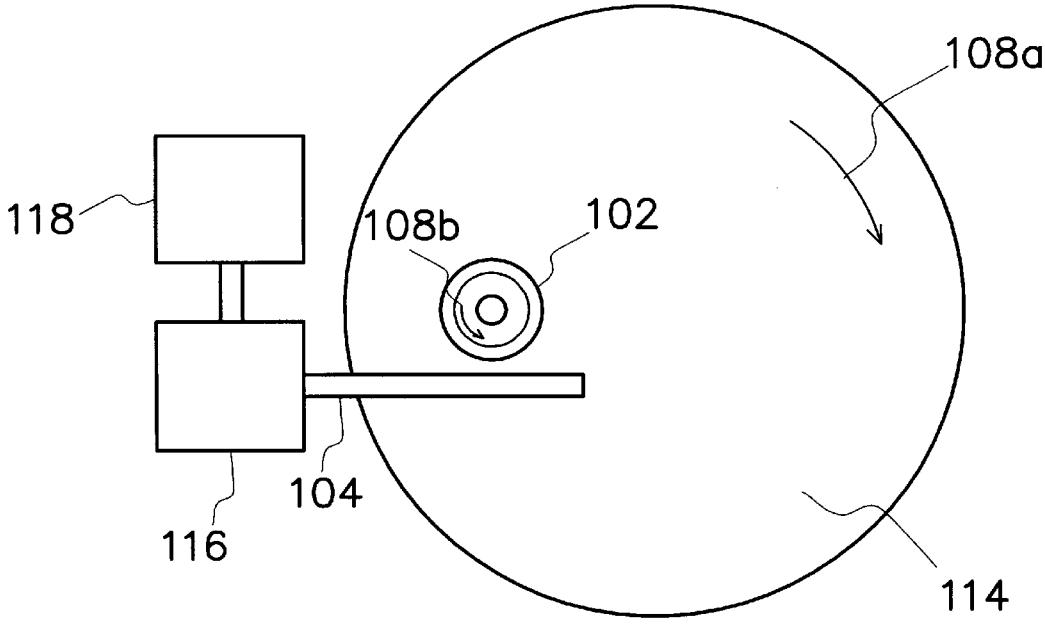
FIG. 1 (PRIOR ART)
FIG. 1 and FIG. 2 are schematic top view and side view of planarized process apparatus for CMP known in prior art.
Figure 2:
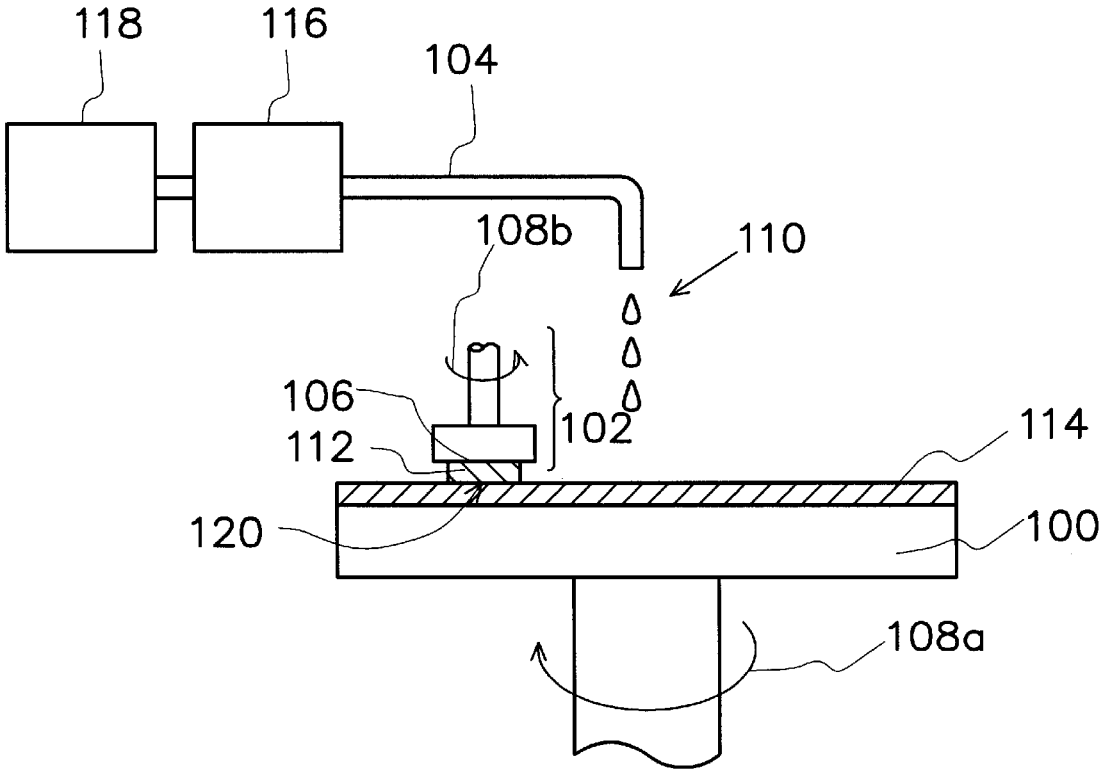
FIG. 2 (PRIOR ART)
Figure 3:
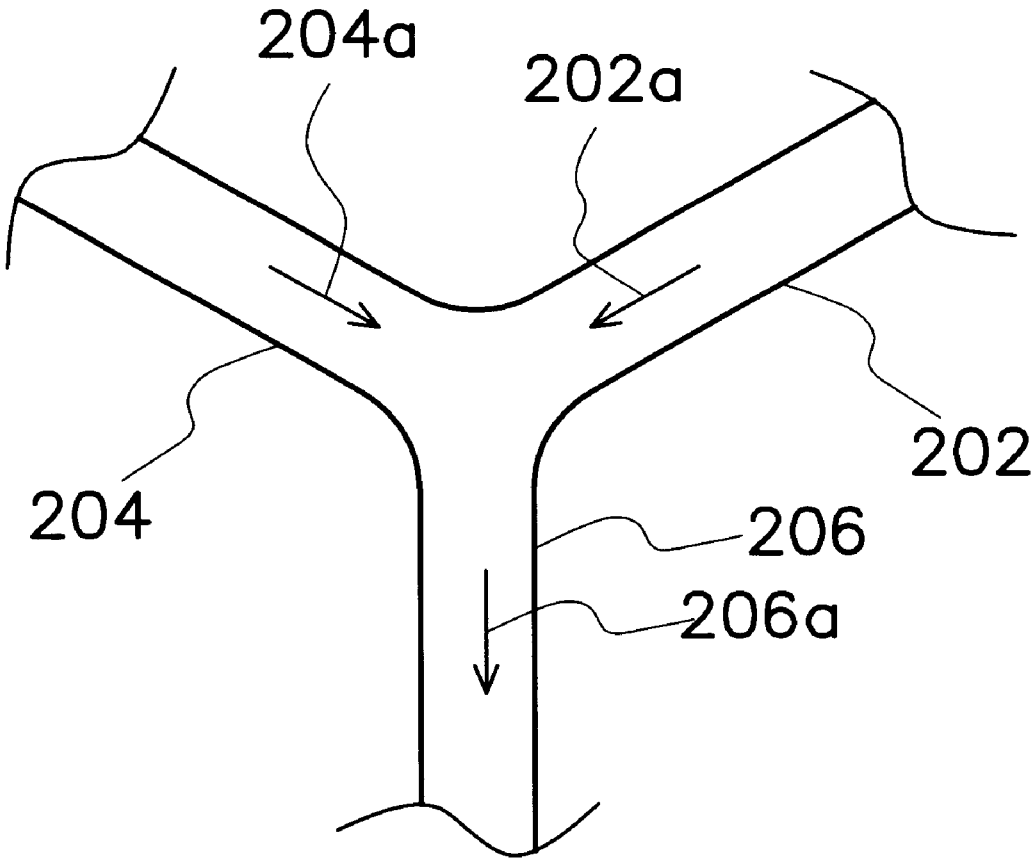
FIG. 3 (PRIOR ART)
FIG. 3 is a cross sectional view of the in-situ slurry mixing apparatus known in prior art.

The slurry input pipe 302 and the slurry output pipe 304 are connected to the mixing chamber 300 through the surrounding wall 322. The slurry input pipe 302 is further connected to a supplying pipe 306 with the other end. While the slurry is input to the mixing chamber 300 via the slurry input pipe 302 with a direction shown as arrow 302*a,* the blades 310 are rotating and sliding through an interior surface of the surrounding wall 322. The slurry output pipe 304 is connected to the mixing chamber 300 with one end, and with the other end outputting the slurry to the CMP polisher with a direction shown as arrow 304*a* (shown as FIG. 1A and FIG. 1B). Referring to FIG. 5, several kinds of the slurry materials are pumped into the slurry input pipe 304 through the pipes 306, 308 along the direction of the arrow directions 306*a,* 308*a* and continuously enter the mixing chamber 300. When the slurry enters the mixing chamber 300 and beat one of the blades 310, the slurry flow is swirled along the direction shown as the arrow 318, and the blades 310 are accelerated and driven by the slurry. As a consequence, the blades 310 rotate along the direction shown as the arrow 320. By rotating the blades 310, the slurry is carried and stirred by the blades 310. While the slurry is carried towards the slurry output pipe 304, an evenly mixed slurry is obtained and supplied to the chemical mechanical polisher. As shown in the figure, the blades 310 are curved in a clockwise direction. It is appreciated that other shapes, for example, curved in a counterclockwise direction, or flat shape, may also be applied to achieve the evenly mixing purpose. Furthermore, in this embodiment, the blades 310 are rotating in a counterclockwise direction as shown as the arrow 320. While the locations of the slurry input pipe 302 and the slurry output pipe 304 are interchanged, the blades 310 are then rotating in an opposite direction, that is, a clockwise direction.

The size of the slurry input pipe 302 is about 1/100 of the size of the mixing chamber 300. For example, while the diameter of the mixing chamber 300 is 3 inches, the diameter of the slurry input pipe is about 0.03 inch. The mixing chamber 300 is made of acid-base-resistant material, such as TEFLON, PFMA (Polyfluorinated methacrylate) or the likes. The material of the blades 310 includes acid- and base-resistant material, for example, TEFLON, PFMA or the likes.

The slurry mixing apparatus in FIG. 4 only shows one slurry input pipe 302 and one slurry output pipe 304. In the practical application, the slurry mixing apparatus may comprises more than one slurry input/output pipes, that is, one slurry output pipes and several slurry inputs, several slurry output pipes and one slurry input pipes, or even several input pipes and slurry output pipes as specifically required.

Since the slurry is pumped into the mixing chamber 300 through the slurry input 314 and the blades 310 are rotated to stir the slurry to induce convolution of the slurry, the slurry is thus evenly mixed inside of the mixing chamber 300. In addition, while performing polishing, fresh mixing slurry is continuously pumped into the slurry input pipe 302 and the flows into the CMP polisher. The slurry supplying to the chemical mechanical polisher is therefore uniform and fresh, so that the property of the slurry does not vary with time. The problem of time varying property of the slurry in the conventional pre-mixing process can be solved. Therefore, the chemical mechanical polishing process can be more stable than that in prior art. The problem of short mixing time of in-situ slurry mixing apparatus in prior art can be overcome by this invention. The property of the slurry is easily controlled to enhance the performance of the CMP.

Figure 6:
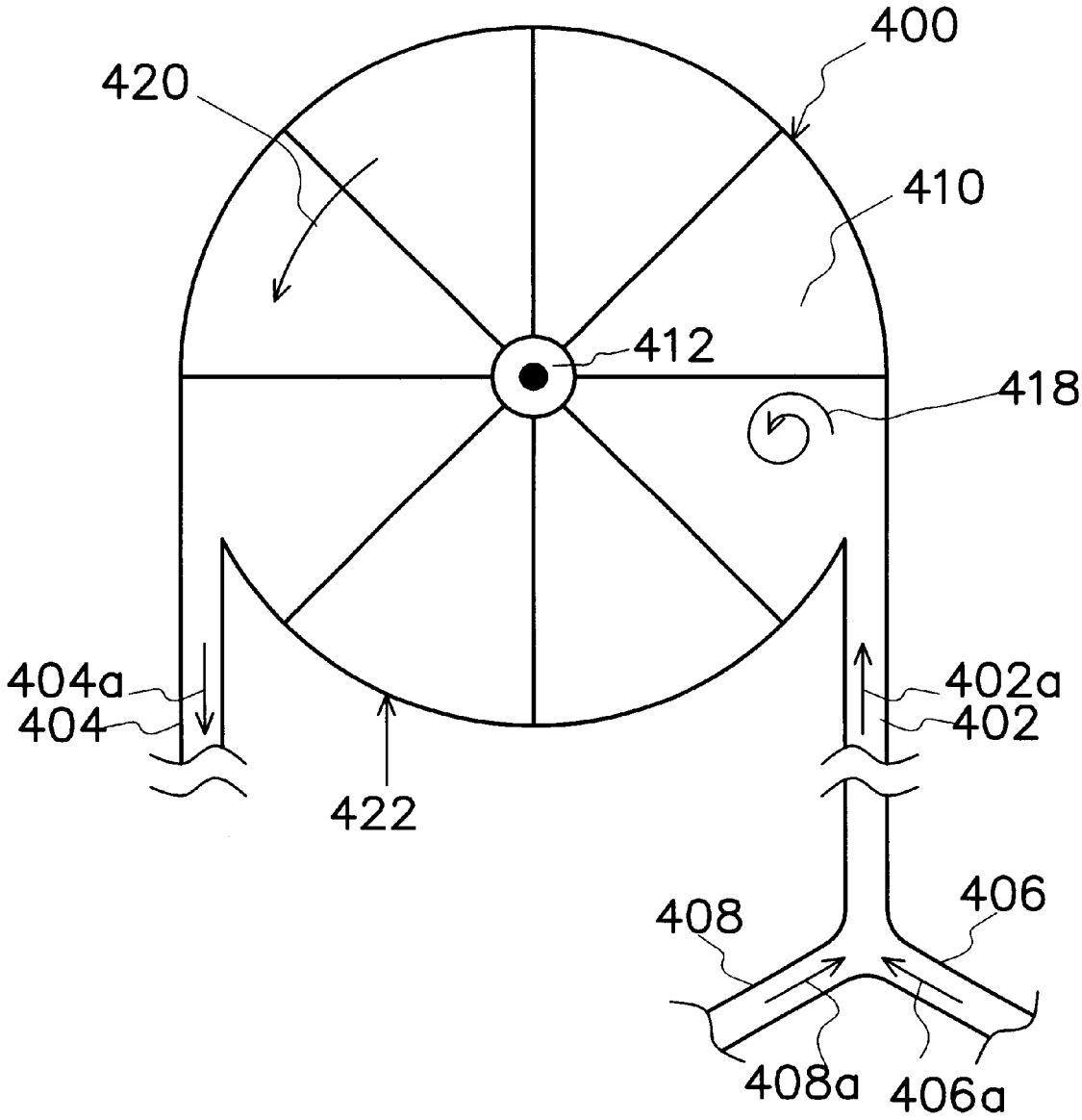
FIG. 6 shows a schematic side view of a slurry mixing apparatus similar to that shown in FIG. 5, except having flat blades.

Reference is made briefly to FIG. 6, which shows a schematic side view of a slurry mixing apparatus similar to that shown in FIG. 5, except having flat blades. In this regard, the reference numbers for the apparatus of FIG. 6 are similar to FIG. 5, except that the leading digit has been changed from "3" to "4". With regard to the mechanics of operation, the slurry mixing apparatus of FIG. 6 operates similar to that of FIG. 5, therefore no further discussion need be provided.

Figure 7:
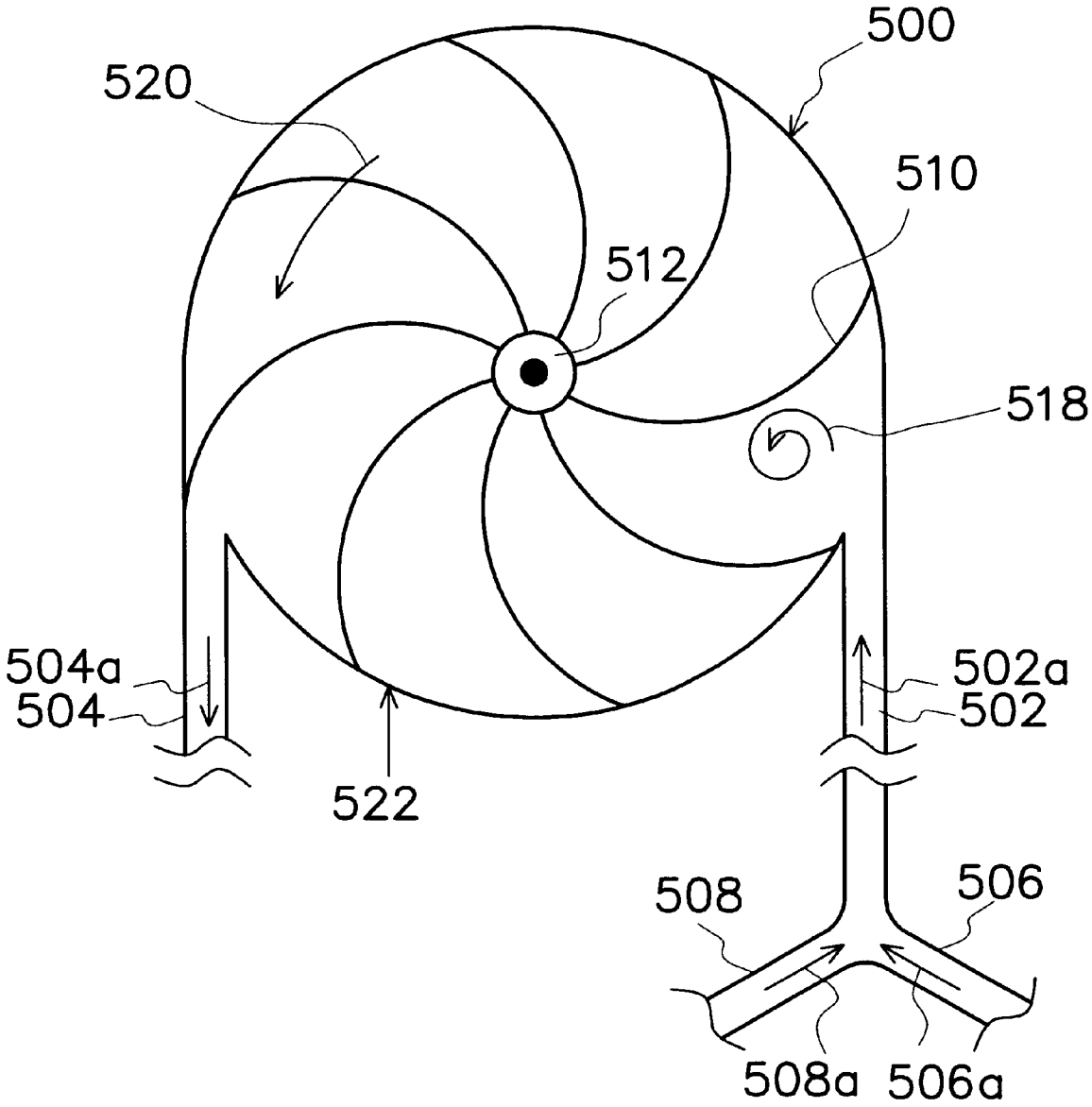
FIG. 7 shows a schematic side view of a slurry mixing apparatus similar to that show in FIG. 5, except having blades curved in a counterclockwise direction.

Reference is made briefly to FIG. 7, which shows a schematic side view of a slurry mixing apparatus similar to that shown in FIG. 5, except having flat blades. In this regard, the reference numbers for the apparatus of FIG. 7 are similar to FIG. 5, except that the leading digit has been changed from "3" to "5". With regard to the mechanics of operation, the slurry mixing apparatus of FIG. 7 operates similar to that of FIG. 5, therefore no further discussion needs to be provided.

As described above, the features of this invention include:

1. Since the slurry is pumped into the mixing chamber through the slurry input pipe, and the slurry is swirled while beating by the blades. The slurry is thus carried, mixed, and stirred by the blades, so that a uniformly mixed slurry is obtained and supplied for the polishing process. As a consequence, the performance of CMP is enhanced.
2. Since fresh slurry is pumped into the mixing chamber continuously, and the uniformly mixed slurry is supplied to the CMP polisher, the property of the mixing slurry does not vary form time and the CMP process is more stable.
3. The apparatus of the invention is compatible with the current CMP polisher, so that there is no problem for implementing the apparatus into the current CMP polisher for manufacturing.

Other embodiment of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. A method for mixing slurries used in a chemical mechanical polisher, comprising:

inputting slurries into a mixing chamber, wherein the mixing chamber comprises a plurality of blades and a bearing, and the blades are connected to the bearing;

driving the blades with a force from the introduction of the slurries into the mixing chamber;

stirring the slurries by the rotating blades to mix the slurries; and outputting the slurries into a chemical mechanical polisher.

2. The method of claim 1, wherein the step of stirring the slurries by the rotating blades comprises stirring the slurries by the rotating blades with an embowed shape.

3. The method of claim 1, wherein the step of stirring the slurries by the rotating blades comprises stirring the slurries by the rotating blades curved in a clockwise direction.

4. The method of claim 1, wherein the step of stirring the slurries by the rotating blades comprises stirring the slurries by the rotating blades curved in a counterclockwise direction.

5. The method of claim 1, wherein the step of stirring the slurries by the rotating blades comprises stirring the slurries by the rotating blades in a flat shape.

6. The method of claim 1, further comprising the step of sliding the blades along an interior surface of the mixing chamber.

7. The method of claim 1, wherein the step of inputting slurries into a mixing chamber comprises inputting slurries into a mixing chamber made of TEFLON.

8. The method of claim 1, wherein the step of inputting slurries into a mixing chamber comprises inputting slurries into a mixing chamber made of TEFLON.

* * * * *